US009500971B2

(12) United States Patent
Kmiecik-Lawrynowicz et al.

(10) Patent No.: US 9,500,971 B2
(45) Date of Patent: Nov. 22, 2016

(54) TONER COMPOSITION

(75) Inventors: Grazyna Kmiecik-Lawrynowicz, Fairport, NY (US); Daniel A. Asarese, Honeoye Falls, NY (US); Maura A. Sweeney, Irondequoit, NY (US); Robert D. Bayley, Fairport, NY (US); Mark Mang, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 13/280,331

(22) Filed: Oct. 24, 2011

(65) Prior Publication Data

US 2013/0101935 A1 Apr. 25, 2013

(51) Int. Cl.
*G03G 9/08* (2006.01)
*G03G 9/093* (2006.01)

(52) U.S. Cl.
CPC ..... *G03G 9/0821* (2013.01); *G03G 9/093* (2013.01); *G03G 9/0935* (2013.01); *G03G 9/09307* (2013.01); *G03G 9/09321* (2013.01); *G03G 9/09392* (2013.01)

(58) Field of Classification Search
CPC ..... G03G 9/093; G03G 9/09307; G03G 9/0935; G03G 9/09392
USPC ..... 430/110.2, 123.52
See application file for complete search history.

(56) References Cited

U.S. PATENT DOCUMENTS

| | | | | |
|---|---|---|---|---|
| 2006/0216628 | A1* | 9/2006 | Nakamura et al. | 430/110.2 |
| 2007/0048643 | A1* | 3/2007 | Kmiecik-Lawrynowicz et al. | 430/108.6 |
| 2007/0087281 | A1* | 4/2007 | Patel et al. | 430/110.2 |
| 2008/0044754 | A1* | 2/2008 | Marcello et al. | 430/110.2 |
| 2008/0044755 | A1* | 2/2008 | Marcello et al. | 430/110.2 |
| 2008/0063966 | A1* | 3/2008 | Mattison et al. | 430/108.7 |
| 2009/0081572 | A1* | 3/2009 | Kmiecik-Lawrynowicz et al. | 430/107.1 |
| 2009/0081575 | A1* | 3/2009 | Kmiecik-Lawrynowicz et al. | 430/137.14 |
| 2010/0297546 | A1* | 11/2010 | Zhou et al. | 430/108.23 |
| 2011/0086304 | A1* | 4/2011 | Asarese et al. | 430/107.1 |

* cited by examiner

*Primary Examiner* — Mark A Chapman
(74) *Attorney, Agent, or Firm* — Pillsbury Winthrop Shaw Pittman LLP

(57) ABSTRACT

A toner is described containing low melt wax and having a core and shell, which toner exhibits improved fusing performance as compared to a toner produced with a high melt wax in the core; having a core resin with a $T_g$ equal to or lower than that of the shell resin; or both.

18 Claims, No Drawings

TONER COMPOSITION

FIELD

Toner, such as, an emulsion aggregation (EA) toner, containing low melt wax, a core with $T_g$ lower than that of the shell, or both, which exhibits improved fusing performance when compared to toner containing a high melt wax, a core with a $T_g$ higher than that of the shell, or both; developers comprising said toner; devices comprising the toner and developers; imaging device components comprising the toner and developers; imaging devices comprising the developers; and so on, are described.

BACKGROUND

The present disclosure relates to toners and processes useful in providing toners suitable for electrophotographic apparatus, including digital, image-on-image and similar devices.

Numerous processes are within the purview of those skilled in the art for preparing toner. Emulsion aggregation (EA) is one such method. Such toners are formed by aggregating a colorant with a latex polymer formed by emulsion polymerization. For example, U.S. Pat. No. 5,853,943, the disclosure of which hereby is incorporated by reference in entirety, is directed to a semicontinuous emulsion polymerization process for preparing a latex by first forming a seed polymer. Other examples of emulsion/aggregation/coalescing processes for preparing toners are illustrated in U.S. Pat. Nos. 5,403,693, 5,418,108, 5,364,729, and 5,346,797, the disclosure of each of which hereby is incorporated by reference in entirety. Other processes are disclosed in U.S. Pat. Nos. 5,527,658, 5,585,215, 5,650,255, 5,650,256 and 5,501,935, the disclosure of each of which hereby is incorporated by reference in entirety.

There is a continual need for improving the process for forming toner with improved fusing performance.

SUMMARY

The present disclosure provides toners and processes for preparing toner particles having improved fusing characteristics. Toners of the present disclosure may be prepared by the incorporation of a low melt wax for improved fusing performance.

In embodiments, a toner composition is disclosed including a core resin comprising a low melt wax, and a shell resin, where the wax has a melting point of less than about 95° C. In addition, the $T_g$ of the core resin can be lower than the $T_g$ of the shell resin. The toner can have a viscosity of less than about 1400 P, less than about 1300 P, less than about 1200 P.

In embodiments, a toner composition is disclosed including a core resin comprising a low melt wax, and a shell resin, where the low melt wax includes a paraffin wax, a microcrystalline wax, a montan wax, an ozokerite wax, a ceresin wax, a petrolatum wax or a petroleum wax. In addition, the $T_g$ of the core resin can be lower than the $T_g$ of the shell resin.

In embodiments, a process for improving the fusing performance of toner compositions is disclosed including mixing a core resin comprising an optional surfactant, a low melt wax, an optional colorant, and optionally one or more other colorants; and then adding a shell resin. The $T_g$ of the shell resin is greater than the $T_g$ of the core resin. The resulting toner composition exhibits lower rheology metrics and better fusing performance when compared to a toner produced with a higher melt wax, comprising a core resin having an equal or higher $T_g$ than that of the shell resin, or both.

In embodiments, an imaging component comprising a toner is disclosed, where the toner includes a core resin comprising an optional surfactant, a low melt wax, a colorant, and optionally one or more other colorants, and a shell resin. The $T_g$ of the shell resin can be greater than the $T_g$ of the core resin.

In embodiments, a developer is disclosed which includes an imaging component containing a toner where the toner includes a core resin comprising an optional surfactant, a low melt wax, an optional colorant and optionally one or more other colorants, and a shell resin. The $T_g$ of the shell resin can be greater than the $T_g$ of the core resin.

DETAILED DESCRIPTION

While not being bound by theory, toner formulations using a lower $T_g$ resin for a core and the same or a lower $T_g$ resin in a shell may cause problems with toner blocking. Replacing a lower $T_g$ resin in the shell with a higher $T_g$ resin for the shell may improve blocking performance; however, such replacing may have negative consequences on fusing or fusing performance (e.g., image removal by abrasion).

The present disclosure provides toner compositions with improved fusing performance (e.g., improved paper adhesion of particles). In embodiments, a toner composition is disclosed including a core resin, a shell resin and a low melt wax, wherein the wax has a melting point of less than about 95° C., and optionally, wherein the $T_g$ of the core resin is lower than the $T_g$ of the shell resin.

Fusing performance can be determined in art-recognized fashion, such as, excellent crease fix performance and half-tone rub fix performance (paper adhesion of particles). In general, a toner may display an advantage in crease fix or rub fix performance where the minimum fusing temperature (MFT) to fuse the toner can be reduced.

Improved crease fix or half-tone rub fix performance can be obtained with a toner of interest at fusing temperatures from about, for example, 170° C. to about 220° C., from about 180° C. to about 200° C. The performance can be obtained at various process speeds. The toner image may exhibit a crease fix property of less than about 60, less than about 40; and a half-tone rub fix property of less than about 0.15, less than about 0.12. Half-tone rub fix can be measured as optical density of toner rubbed off an image onto a white cloth. Crease fix performance can be determined as taught in U.S. Pat. No. 7,862,971, herein incorporated by reference in entirety.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating," or, "matching," or grammatical variations thereof, which has generally acceptable definitions or at the least, is understood to have the same meaning as, "about."

As used herein, "high," "higher," "low," "lower," and all grammatic versions thereof are terms relative to the $T_g$ of the resins, waxes and other reagents that comprise a toner, such as, the core and the shell of a toner particle. Thus, in absolute terms, any one temperature may be numerically high, such as a $T_g$ of 55° C., which may be recognized in the art as a higher temperature of that reactant. However, if that resin were to represent the $T_g$ of the core resin, which, in the context of the current disclosure is a lower $T_g$ of a particle of interest, that temperature is, "lower," in the practice of the instant disclosure, and as the $T_g$ of the shell resin of a toner of interest must be greater than that of the core resin, then, in that circumstance, the $T_g$ of the shell must be greater than 55° C.

In embodiments, the $T_g$ of the core resin is at least one degree lower than the $T_g$ of the shell resin, two degrees lower, three degrees lower, four degrees lower or even lower than that of the shell resin.

Use of the singular includes the plural unless specifically stated otherwise. Use of, "or," means, "and/or," unless stated otherwise. Furthermore, use of the term, "including," as well as other forms, such as, "includes," and, "included," is not limiting.

For the purposes of the instant disclosure, "toner," "developer," "toner composition," and "toner particles," may be used interchangeably, and any particular or specific use and meaning will be evident from the context of the sentence, paragraph and the like in which the word or phrase appears.

As used herein, "pH adjuster," means an acid or base, or buffer which may be used to change the pH of a composition (e.g., slurry, resin, aggregate, toner and the like). Such adjusters may include, but are not limited to, sodium hydroxide (NaOH), nitric acid, sodium acetate/acetic acid and the like.

As used herein, "elastic modulus," means the contribution of elastic (solid-like) behavior to the complex modulus. The factor can be denoted by the symbol, "G'."

As used herein, "tan(d)," means the tangent of the phase angle, that is, the ratio of viscous modulus to elastic modulus and can be a useful quantifier of the presence and extent of elasticity in a fluid.

As used herein, "viscosity," refers to the resistance of a fluid to flow. For example, in shear deformation, viscosity is the ratio of applied shear stress to resulting shear rate. Viscosity typically is reported in units of poise (P) and centipoise (cP), or pascal seconds (Pa·s) or millipascal seconds (mPa·s). For example, in embodiments, the viscosity of the toner composition of the present disclosure is less than about 1400 P, less than about 1300 P, between about 1000 and 1400 P, about 1200 P.

As used herein, "viscous modulus," means the contribution of viscous (liquid-like) behavior to the complex modulus. The factor commonly is denoted by the symbol, "G'."

Complex modulus or dynamic modulus can be represented by the sum of the viscous modulus and the elastic modulus measurements of a material.

The melt flow index (MFI) of toners produced in accordance with the present disclosure may be determined by methods within the purview of those skilled in the art, including use of a plastometer. For example, the MFI of the toner may be measured on a Tinius Olsen extrusion plastometer at about 125° C. with about 5 kilograms load force. Samples then may be dispensed into the heated barrel of the melt indexer, equilibrated for an appropriate time, in embodiments, from about five minutes to about seven minutes, and then the load force of about 5 kg may be applied to the melt indexer piston. The applied load of the piston forces the molten sample out a predetermined orifice opening. The time for the test may be determined when the piston travels one inch. The melt flow may be calculated by the use of the time, distance and weight volume extracted during the testing procedure.

MFI as used herein thus includes, in embodiments, for example, the weight of a toner (in grams) which passes through an orifice of length, L, and diameter, D, in a 10 minute period with a specified applied load (for example, as noted above, 5 kg). An MFI unit of 1 thus indicates that only 1 gram of the toner passed through the orifice under the specified conditions in 10 minutes. "MFI units," as used herein thus refers to units of grams per 10 minutes. In embodiments, a toner of interest has an MFI of at least about 18 gm/10 min at a temperature of 125° C., at least about 19 gm/10 min at a temperature of 125° C., at least about 20 gm/10 min at a temperature of 125° C. or more.

Toner particles of interest comprise a resin, such as, an acrylate resin, a styrene resin and so on as known in the art. A composition may comprise more than one form or sort of polymer, such as, two or more different polymers, such as, two or more different polymers composed of different monomers. The polymer may be an alternating copolymer, a block copolymer, a graft copolymer, a branched copolymer, a crosslinked copolymer and so on.

The toner particle may include other optional reagents, such as, a surfactant, a wax, a shell and so on. In embodiments, a toner of interest comprises a low melt wax in the core. The core $T_g$ may be lower than the $T_g$ of the shell. In embodiments a toner comprises both features. The toner composition optionally may comprise inert particles, which may serve as toner particle carriers, which may comprise a resin taught herein. The inert particles may be modified, for example, to serve a particular function. Hence, the surface thereof may be derivatized or the particles may be manufactured for a desired purpose, for example, to carry a charge or to possess a magnetic field.

Resins

Toner particles of the instant disclosure can include a resin forming monomer suitable for use in forming a particulate containing or carrying a colorant of a toner for use in certain imaging devices.

Examples of a latex include styrene-based monomers, including styrene acrylate-based monomers. Thus, for example, examples of styrene-based monomers and acrylate-based monomers and polymers include, for example, styrene, styrene acrylates, styrene butadienes, styrene methacrylates, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly (butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), styrene/butyl acrylate/carboxylic acid terpolymers, styrene/butyl acrylate/beta-carboxy ethyl acrylate terpolymers, other similar polymers and combinations thereof. In the above materials, the alkyl group can have, for example, from 1 to about 40 carbon atoms, from 1 to about 10, or to about 20 carbon atoms, from 1 to about 5 carbon atoms.

The monomers used in making the selected polymer are not limited, and the monomers utilized may include any one or more of, for example, styrene, acrylates, such as, methacrylates, butylacrylates, β-carboxy ethyl acrylate (β-CEA) etc., butadienes, isoprenes, acrylic acids, methacrylic acids, itaconic acids, acrylonitriles, benzenes, such as, divinylbenzene etc. and the like. Mixtures of two or more of such polymers can also be used, if desired.

In embodiments, the resin may be selected to contain a carboxylic acid group selected, for example, from the group comprised of, but not limited to, acrylic acid, methacrylic acid, itaconic acid, β-CEA, fumaric acid, maleic acid and cinnamic acid, and wherein, for example, a carboxylic acid is selected in an amount of from about 0.01 to about 15%, from about 0.1 to about 10% of the total weight of the resin, from about 1 to about 5%.

In embodiments, the latex emulsion polymer is a styrene polymer, such as a styrene-alkyl acrylate polymer, or a mixture of two or more such styrene polymers or styrene-alkyl acrylate polymers. For example, in one embodiment, the latex emulsion polymer is a styrene/butyl acrylate/β-CEA terpolymer. In embodiments, the resin or polymer can be styrene/butyl acrylate/acrylic acid terpolymer, styrene/butyl acrylate/methacrylic acid terpolymer, styrene/butyl acrylate/itaconic acid terpolymer, styrene/butyl acrylate/furmaic acid terpolymer, styrene/butadiene/β-carboxyethylacrylate terpolymer, styrene/butadiene/methacrylic acid terpolymer, styrene/butadiene/acrylic acid terpolymer, styrene/isoprene/beta-carboxyethylacrylate terpolymer and the like.

Known chain transfer agents, for example, dodecanethiol or carbon tetrabromide, can be utilized to control the molecular weight properties of the polymer. The chain transfer agent may be present in an amount of from about 0.01 to about 15%, from about 0.5 to about 10% by weight based on the combined weight of the monomers, from about 1 to about 5%, although amounts outside of those ranges can be used.

Although not limited to any particular resins or properties, the polymer resin used can be quantified or described by various physical properties. For example, in embodiments, the polymer resin can have a weight average molecular weight ($M_w$) of about 25,000 to about 50,000, from about 30,000 to about 40,000, a number average molecular weight ($M_n$) of about 7,000 to about 20,000, from about 9,000 to about 15,000 from about 10,000 to about 12,000, and a $T_g$ (onset) of about 48° C. to about 62° C., from about 49° C. to about 55° C., from about 51° C. to about 54° C.

In embodiments, the polymer resin is a non-cross linked resin that is substantially free of cross linking. As used herein, "substantially free of cross linking," (also referred to herein as a non-cross linked resin) refers for example to a resin having less than about 10%, less than about 5%, less than about 1% cross linking between and among polymer chains. Thus, in embodiments, the resin latex is substantially free of cross linking as to any functional groups that may be present in the resin, meaning that the entire resin latex has less than about 10%, such as less than about 5%, less than about 1%, less than about 0.1% cross linking.

As will be apparent, the properties of the resin can be adjusted suitably by altering the types and amounts of constituent monomers, adjusting the type and amount of chain transfer agents and the like. For example, adjusting the ratio of constituent monomers can adjust the $T_g$, which in turn, can impact blocking properties, fusing properties and the like.

Similarly, adjusting the amount of chain transfer agent used in forming the resin for the core and/or shell can adjust resin properties. For example, using different amounts of chain transfer agent, such as dodecanethiol, when forming the resin latex, can change properties, such as, molecular weight, $T_g$ and the like. For example, increasing the amount of chain transfer agent in forming the core resin latex can decrease the molecular weight due to chain termination during polymerization. Decreasing the amount of chain transfer agent in forming the shell resin latex will increase the molecular weight which can aid blocking properties.

The monomer units used to form the resin latex or latexes can be suitably polymerized by any known process. For example, the monomer units can be polymerized in a starve fed semi-continuous emulsion polymerization process, a standard emulsion polymerization process or the like. For example, the monomers can be polymerized under starve fed conditions as referred to in U.S. Pat. Nos. 6,447,974, 6,576,389, 6,617,092, and 6,664,017, the entire disclosure of each of which is incorporated herein by reference, to provide latex resin particles having a diameter in the range of about 100 to about 300 nm.

In embodiments, the resins of a core exhibit a $T_g$ which is less than the $T_g$ of the toner particle shell; the $T_g$ of the core can be less than about 60° C., less than about 50° C., less than about 40° C. In embodiments, the $T_g$ of the core can be between about 45° C. and about 50° C. The two temperatures, hence resins, are selected coordinately to obtain suitable fusing without blocking. Thus, the core temperature is the same or less than that of the shell.

Surfactants

In embodiments, the latex may be prepared in an aqueous phase containing a surfactant or a co-surfactant. Surfactants which may be utilized with the polymer to form a latex dispersion may be ionic or nonionic surfactants, or combinations thereof, in an amount of from about 0.01 to about 15 wt % of the solids, in embodiments, of from about 0.1 to about 10 wt % of the solids, in embodiments, from about 1 to about 7.5 wt % solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R#, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, $C_{12}$,$C_{15}$,$C_{17}$-trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ may be utilized.

The choice of particular surfactants or combinations thereof, as well as the amounts of each to be used, is within the purview of those skilled in the art.

Initiators

In embodiments, initiators may be added for formation of the latex polymer. Examples of suitable initiators include water soluble initiators, such as, ammonium persulfate, sodium persulfate and potassium persulfate and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methylpropionamidine]dihydrochloride, 2,2'-azobis[N-(4-aminophenyl)-2-methylpropionamidine]tetrahydrochloride, 2,2'-azobis[2-methyl-N(phenylmethyl)propionamidine] dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis[2-[1-(2-hydroxyethyl)-2-imidazolin-2-yl]propane]dihydrochloride, combinations thereof, and the like.

Initiators may be added in suitable amounts, such as from about 0.1 to about 8 wt % of the monomers, from about 0.2 to about 5 wt % of the monomers, from about 0.5 to about 4 wt % of the monomers.

Chain Transfer Agents

In embodiments, chain transfer agents also may be utilized in forming the latex polymer. Suitable chain transfer agents include dodecane thiol, octane thiol, carbon tetrabromide, combinations thereof, and the like, in amounts from about 0.1 to about 10% of monomers, from about 0.2 to about 5% by weight of monomers, from about 0.5 to about 3.5% by weight of monomers, to control the molecular weight properties of the latex polymer when emulsion polymerization is conducted in accordance with the present disclosure and as known in the art.

Functional Monomers

In embodiments, it may be advantageous to include a functional monomer when forming the latex polymer and the particles made from the polymer. Suitable functional monomers include monomers having a carboxylic acid functionality or pendant group. Such monomers may be of the following formula:

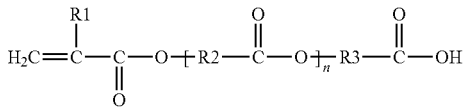

where R1 is hydrogen or a methyl group; R2 and R3 are independently selected from alkyl groups containing from about 1 to about 12 carbon atoms or a phenyl group; n is from 0 to about 20, in embodiments from 1 to about 10. Examples of such functional monomers include β-CEA, poly(2-carboxyethyl)acrylate, 2-carboxyethyl methacrylate, combinations thereof and the like. Other functional monomers which may be utilized include, for example, acrylic acid, methacrylic acid and derivatives thereof, and combinations of the foregoing.

In embodiments, the functional monomer having a carboxylic acid functionality also may contain a small amount of metallic ions, such as, sodium, potassium and/or calcium, to achieve better emulsion polymerization results. The metallic ions may be present in an amount from about 0.001 to about 10% by weight of the functional monomer having a carboxylic acid functionality, from about 0.5 to about 5% by weight of the functional monomer having a carboxylic acid functionality, from about 0.75 to about 4% by weight of the functional monomer having a carboxylic acid functionality.

Where present, the functional monomer may be added in amounts from about 0.01 to about 10% by weight of the total monomers, in embodiments from about 0.05 to about 5% by weight of the total monomers, and in embodiments from about 0.1 to about 3% by weight of total monomers.

Wax

Wax or wax dispersions also may be added during formation of a latex polymer in an emulsion aggregation synthesis. Suitable waxes include, for example, submicron wax particles in the size range of from about 50 to about 1000 nm, from about 100 to about 500 nm in volume average diameter, such as those suspended in an aqueous phase of water and an ionic surfactant, nonionic surfactant or combinations thereof. Suitable surfactants include those described above. The ionic surfactant or nonionic surfactant may be present in an amount of from about 0.1 to about 20% by weight, from about 0.5 to about 15% by weight of the wax.

The wax or wax dispersion according to embodiments of the present disclosure may include, for example, a mineral wax, and/or a synthetic wax. Examples of mineral waxes include, for example, paraffin wax, microcrystalline wax, montan wax, ozokerite wax, ceresin wax, petrolatum wax and petroleum wax.

In embodiments, the waxes may be functionalized. Examples of groups added to functionalize waxes include amines, amides, imides, esters, quaternary amines and/or carboxylic acids. In embodiments, the functionalized waxes may be acrylic polymer emulsions, for example, JONCRYL 74, 89, 130, 537 and 538, all available from Johnson Diversey, Inc, or chlorinated polypropylenes and polyethylenes, commercially available from Allied Chemical, Baker Petrolite Corporation and Johnson Diversey, Inc.

In embodiments, the wax is a low melt wax having a melting point of about 95° C. or less, about 90° C. or less, about 85° C. or less, about 80° C. or less.

Additional examples of low melt waxes having a melting point of 100° C. or less that may be used include POLYWAX 655 (melting point of 99° C.), POLYWAX 600 (melting point of 94° C.) and POLYWAX 500 (melting point of 88° C.), each available from Baker Petrolite; waxes from the Baker Petrolite propylene/hexene copolymer series, including, X-10018 (melting point of 94° C.); waxes from the Baker Petrolite ethylene/propylene copolymer series, including EP-700 (melting point of 94° C.), EP-1104 (melting point of 100° C.), silicone waxes; aliphatic amide waxes, including oleic amide, erucic amide, ricinolic amide and stearic amide; and mineral or petroleum waxes, including montan wax, ozocerite, ceresine, paraffin wax and microcrystalline wax.

In addition, other waxes may include, bamboo leaf (79° C.-80° C.), bayberry (46.7° C.-48.8° C.), beeswax (61° C.-69° C.), candelilla (67° C.-69° C.), Cape berry (40.5° C.-45° C.), carandá (79.7° C.-84.5° C.), carnuba (83° C.-86° C.), castor oil (83° C.-88° C.), Japan wax (48° C.-53° C.) and jojoba (11.2° C.-11.8° C.).

The low melt wax may be present in an amount of from about 2 to about 8% by weight of the toner, from about 1 to about 6% by weight of the toner, from about 0.1 to about 30% by weight, from about 2 to about 20% by weight of the toner. In embodiments, the amount of low melt wax present in the toner composition of the present disclosure is reduced by about half compared to that of an equivalent toner composition using a high melt wax.

Combinations of any of the low melt waxes of interest can be used in a core of a toner particle.

Colorants

The latex particles may be added to a colorant dispersion. The colorant dispersion may include, for example, submicron colorant particles having a size of, for example, from about 50 to about 500 nm in volume average diameter and, in embodiments, of from about 100 to about 400 nm in volume average diameter. The colorant particles may be suspended in an aqueous phase containing an ionic surfactant, a nonionic surfactant or combinations thereof. In embodiments, the surfactant may be ionic and may be from about 1 to about 25% by weight, from about 4 to about 15% by weight, of the colorant.

Colorants useful in forming toners in accordance with the present disclosure include pigments, dyes, mixtures of pigments and dyes, mixtures of pigments, mixtures of dyes and the like. The colorant may be, for example, carbon black, cyan, yellow, magenta, red, orange, brown, green, blue, violet or combinations thereof. In embodiments, a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including, RHODAMINE B™ type, and the like.

The colorant may be present in the toner of the disclosure in an amount of from about 1 to about 25% by weight of toner, from about 2 to about 15% by weight of the toner.

Exemplary colorants include carbon black, such as, REGAL 330® magnetites; Mobay magnetites including MO8029™, MO8060™; Columbian magnetites; MAPICO BLACKS™ and surface-treated magnetites; Pfizer magnetites including CB4799™, CB5300™, CB5600™, MCX6369™; Bayer magnetites including, BAYFERROX 8600™, 8610™; Northern Pigments magnetites including, NP604™, NP608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as C1 60710, C1 Dispersed Red 15, diazo dye identified in the Color Index as C1 26050, C1 Solvent Red 19, copper tetra(octadecyl sulfonamido) phthalocyanine, x-copper phthalocyanine pigment listed in the Color Index as C1 74160, C1 Pigment Blue, Anthrathrene Blue identified in the Color Index as C1 69810, Special Blue X-2137, diarylide yellow 3,3-dichlorobenzidene acetoacetanilides, a monoazo pigment identified in the Color Index as C1 12700, C1 Solvent Yellow 16, a nitrophenyl amine sulfonamide identified in the Color Index as Foron Yellow SE/GLN, C1 Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example, from about 0.5 to about 20% by weight, from about 5 to about 18 wt % of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

pH Adjustment Agent

In some embodiments, a pH adjustment agent may be added to control the rate of the emulsion aggregation process. The pH adjustment agent may be any acid or base that does not adversely affect the products being produced. Suitable bases may include metal hydroxides, such as, sodium hydroxide, potassium hydroxide, ammonium hydroxide and combinations thereof. Suitable acids include nitric acid, sulfuric acid, hydrochloric acid, citric acid, acetic acid and combinations thereof.

Coagulants

In embodiments, a coagulant may be added during or prior to aggregating the latex and the aqueous colorant dispersion. The coagulant may be added over a period of from about 1 minute to about 60 minutes, from about 1.25 minutes to about 20 minutes, from about 2 minutes to about 15 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. PAC may be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

The polymetal salt may be in a solution of nitric acid, or other diluted acid solution, such as, sulfuric acid, hydrochloric acid, citric acid or acetic acid. The coagulant may be added in an amount from about 0.01 to about 5% by weight of the toner, from about 0.1 to about 3% by weight of the toner, from about 0.5 to about 2% by weight of the toner.

Chelating Agents

In embodiments, suitable chelating agents include a polydentate ligand, for example, ethylenediaminetetraacetic acid (EDTA), diethylene triamine pentaacetic acid (DTPA) or ethylene glycol tetraacetic acid (EGTA). The chelating agent may be in an aqueous solution. The chelator may be added in an amount from about 0.01 to about 6% by weight of the toner, from about 0.05 to about 4% by weight of the toner, from about 0.1 to about 1% by weight of the toner.

Shell

In embodiments, a shell is formed on the aggregated particles. In embodiments, the shell comprises a resin with a $T_g$ that is higher than that of the core.

For example, the higher $T_g$ resin may comprise monomers, such as styrene, butyl acrylate and β-CEA, or any other resin taught herein and as known in the art.

Instead of β-CEA, the shell resin, as well as the core resin, may include any carboxylic acid-containing monomer, such as, maleic acid, citraconic acid, itaconic acid, alkenyl succinic acid, fumaric acid, mesaconic acid, maleic acid anhydride, citraconic anhydride, itaconic acid anhydride, alkenyl succinic acid anhydride, maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenyl succinic acid methyl half ester, fumaric acid methyl half ester, half ester of the partial saturation dibasic acid, such as, mesaconic acid methyl half ester, dimethyl maleic acid, the partial saturation dibasic acid ester, such as, dimethlyl fumaric acid, acrylic acid, methacrylic acid, α-like crotonic acid, cinnamon acid, β-partial saturation acid, crotonic acid anhydride, cinnamon acid anhydride, alkenyl nalonic acid, a monomer which has an alkenyl glutaric acid and alkenyl adipic acids.

The higher $T_g$ resin disclosed herein may be substantially free of crosslinking and may have crosslinked density less than about 0.1%, such as, less than about 0.05%. As used herein, "crosslink density," refers to the mole fraction of monomer units that are crosslinking points. For example, in a system where 1 of every 20 molecules is a divinylbenzene and 19 of every 20 molecules is a styrene, only 1 of 20 molecules would crosslink. Thus, in such a system, the crosslinked density would be 0.05.

Other resins suitable for preparing the shell, as well as the core, include styrene acrylates, styrene methacrylates, butadienes, isoprene, acrylonitrile, acrylic acid, methacrylic acid, beta-carboxy ethyl acrylate, polyesters, known polymers such as poly(styrene-butadiene), poly(methyl styrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methlacrylate-isoprene), poly (butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/β-carboxyethylacrylate terpolymer.

In embodiments, the resin utilized to form the shell may have a $T_g$ of from about 53° C. to about 75° C., in embodiments, from about 65° C. to about 70° C., so long as the temperature is the same or is higher than that of the core. The $T_g$ of the shell resin can be less than about 60° C., less than about 55° C., less than about 50° C.

The $M_w$ of the higher $T_g$ resin may be from about 20,000 to about 60,000, from about 25,000 to about 50,000, from about 30,000 to about 40,000.

The shell resin may be applied by any method within the purview of those skilled in the art, including dipping, spraying and the like. The shell resin may be applied until the desired final size of the toner particles is achieved, in embodiments, from about 3 μm to about 12 μm, from about 4 μm to about 8 μm, from about 5 μm to about 7 μm. In embodiments, the toner particles may be prepared by in situ seeded semicontinuous emulsion copolymerization of the resin with the addition of the shell resin once aggregated particles have formed.

Reaction Conditions

In the emulsion aggregation process, the reactants may be added to a suitable reactor, such as, a mixing vessel. The resulting blend of resin, optionally, in a dispersion, optional colorant dispersion, low melt wax and optional coagulant then may be stirred and heated to a temperature at or above the $T_g$ of the resin, in embodiments from about 30° C. to about 70° C., from about 40° C. to about 65° C., from about 45° C. to about 60° C., for a period of from about 0.2 hours to about 6 hours, from about 0.3 hours to about 5 hours, from about 0.5 hours to about 3 hours, resulting in toner aggregates of from about 3 μm to about 15 μm in volume average diameter, from about 4 μm to about 8 μm in volume average diameter, from about 5 μm to about 7 μm in volume average diameter.

In embodiments, the aggregate slurry is, "frozen," once the desired particle size is attained. The chelating agent then can be added to adjust the pH up and to remove some of the ionic bonds within the aggregate particles. Additional base can be added to the mixture to further increase the pH until the aggregates no longer are increasing in size.

Once the desired final size of the toner particles is achieved, the pH of the mixture may be adjusted with a chelating agent, a base or both to a value of from about 3.5 to about 7, from about 4 to about 6.5. The chelating agent may include any suitable polydentate ligand, for example, EDTA, DTPA or EGTA. The chelator may be added in amounts from about 0.01 to about 6% by weight of the toner, from about 0.05 to about 4% by weight of the toner, from about 0.1 to about 1% by weight of the toner.

The base may include any suitable base such as, for example, alkali metal hydroxides, such as, for example, sodium hydroxide, potassium hydroxide and ammonium hydroxide. The alkali metal hydroxide may be added in amounts from about 0.1 to about 30% by weight of the mixture, from about 0.5 to about 15% by weight of the mixture.

The toner particles may be subsequently coalesced. Coalescing may include stirring and heating at a temperature of from about 80° C. to about 100° C., from about 90° C. to about 98° C., for a period of from about 0.5 hours to about 12 hours, from about 1 hour to about 6 hours. Coalescing may be accelerated by additional stirring.

The pH of the mixture may then be lowered to from about 3.5 to about 6, from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about 30% by weight of the mixture, from about 1 to about 20% by weight of the mixture.

The mixture can be cooled in a cooling or freezing step. Cooling may be at a temperature of from about 20° C. to about 40° C., from about 22° C. to about 30° C. over a period of from about 1 hour to about 8 hours, from about 1.5 hours to about 5 hours.

In embodiments, cooling a coalesced toner slurry includes quenching by adding a cooling medium such as, for example, ice, dry ice and the like, to effect rapid cooling to a temperature of from about 20° C. to about 40° C., from about 22° C. to about 30° C. Quenching may be feasible for small quantities of toner, such as, for example, less than about 2 liters, from about 0.1 liters to about 1.5 liters. For larger scale processes, such as, for example greater than about 10 liters in size, rapid cooling of the toner mixture may be practiced using other methods as a design choice, such as, using a jacketed reactor and passing a cooled medium within the jacket spaces or voids.

After cooling, the aggregate suspension may be heated to a temperature at or above the $T_g$ of the latex. Where the particles have a core-shell configuration, heating may be above the $T_g$ of the first latex used to form the core and the $T_g$ of the second latex used to form the shell, to fuse the shell latex with the core latex. In embodiments, the aggregate suspension may be heated to a temperature of from about 80° C. to about 120° C., from about 85° C. to about 98° C., for a period of from about 1 hour to about 6 hours, from about 2 hours to about 4 hours.

Washing

The toner slurry then may be washed. Washing may be carried out at a pH of from about 6 to about 12, from about 6 to about 8. The washing may be at a temperature of from about 25° C. to about 70° C., from about 30° C. to about 50° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

For example, in embodiments, toner particles may be washed in 25° C. deionized water, filtered, reslurried with HCl, filtered and reslurried in fresh deionized water. The washes may continue until the solution conductivity of the filtrate is measured to be low (less than 10 μS/cm), indicating the ion content is significantly reduced, and will not, for example, interfere with metal, in embodiments, zinc, treatment.

In embodiments, the particles then may be subjected to an additional washing step including a metal in solution to enhance charging characteristics. An increase in the amount of certain metals, in embodiments, zinc, on the surface of a toner particle may increase the charging of the toner particles. Thus, a washing step can include a metal.

Additives

Further optional additives may be combined with a toner to enhance the properties of toner compositions. Included are surface additives, color enhancers etc. Surface additives that may be added to the toner compositions after washing or drying include, for example, metal salts, metal salts of fatty acids, colloidal silicas, metal oxides, strontium titanates, combinations thereof and the like, which additives are each usually present in an amount of from about 0.1 to about 10 wt % of the toner, from about 0.5 to about 7 wt % of the toner. Examples of such additives include, for example, those disclosed in U.S. Pat. Nos. 3,590,000, 3,720,617, 3,655,374 and 3,983,045, the disclosure of each of which hereby is incorporated by reference in entirety. Other additives include zinc stearate and AEROSIL R972® available from Degussa. The coated silicas of U.S. Pat. No. 6,190,815 and U.S. Pat. No. 6,004,714, the disclosure of each of which hereby is incorporated by reference in entirety, also may be selected in amounts, for example, of from about 0.05 to about 5% by weight of the toner, from about 0.1 to about 2% by weight of the toner. The additives may be added during the aggregation or blended into the formed toner product.

Toner particles produced utilizing a latex of the present disclosure may have a size of about 1 μm to about 20 μm, about 2 μm to about 15 μm, about 3 μm to about 7 μm. Toner particles of the present disclosure may have a circularity of from about 0.9 to about 0.99 from about 0.92 to about 0.98.

Following the methods of the present disclosure, toner particles may be obtained having several advantages compared with conventional toners: (1) increase in the robustness of triboelectric charging, which reduces toner defects and improves machine performance; (2) easy to implement, no major changes to existing aggregation/coalescence processes; (3) increase in productivity and reduction in unit manufacturing cost (UMC) by reducing the production time and the need for rework (quality yield improvement); and (4) enhanced substrate fusing.

Uses

Toner in accordance with the present disclosure may be used in a variety of imaging devices including printers, copy machines and the like, associated with, for example, imaging processes, such as, xerographic processes, and provide images, such as, colored images with good resolution, good durability, good signal-to-noise ratio and image uniformity. Further, toners of the present disclosure may be selected for electrophotographic imaging and printing processes, such as, digital imaging systems and processes.

The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer.

Developer compositions may be prepared by mixing the toners obtained with the processes disclosed herein with known carrier particles, including coated carriers, such as steel, ferrites and the like. Such carriers include those disclosed in U.S. Pat. Nos. 4,937,166 and 4,935,326, the entire disclosure of each of which is incorporated herein by reference. The carriers may be present from about 2% by weight of the toner to about 8% by weight of the toner, in embodiments, from about 4% by weight to about 6% by weight of the toner. The carrier particles also may include a core with a polymer coating thereover, such as, polymethylmethacrylate (PMMA), having dispersed therein a conductive component, like, conductive carbon black. Carrier coatings include silicone resins, such as, methyl silsesquioxanes, fluoropolymers, such as, polyvinylidiene fluoride, mixtures of resins not in close proximity in the triboelectric series, such as, polyvinylidiene fluoride and acrylics, thermosetting resins, such as, acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. Such a development process can be used in laser scanners.

Development may be accomplished by a magnetic brush development process, as disclosed, for example, in U.S. Pat. No. 2,874,063, the disclosure of which hereby is incorporated by reference in entirety. Such a method entails the carrying of a developer comprising toner of the present disclosure and magnetic carrier particles by a magnet. The magnetic field of the magnet causes alignment of the magnetic carriers in a brush-like configuration and the, "magnetic brush," is brought into contact with the electrostatic image bearing surface of the photoreceptor. The toner particles are drawn from the brush to the electrostatic image by electrostatic attraction to the discharged areas of the photoreceptor and development of the image results. In embodiments, the conductive magnetic brush process is used wherein the developer includes conductive carrier particles and conducts an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The powder-formed image on the photoreceptor or intermediate transfer device is transferred to a support surface, such as, a paper. The transferred image may subsequently be permanently affixed to the support surface by a fusing process, such as, by exposing to heat. Other suitable fixing means such as solvent or overcoating treatment may be substituted for a heat fixing step.

Fusing of toner to a final receiving member, such as, a paper, ensures image fidelity and longevity. Hence, the toner particles can be treated to produce an image more resistant to resolution degradation, caused, for example, by the elements, pressure and so on. For example, when a transferred image is exposed to heat and/or pressure, a suitably prepared toner particle can become malleable to deform or to mold to the receiving member surface, binding thereto or interdigitizing therewith to form a more durable image, as well as providing an image with desirable presentation characteristics of choice. Hence, a, "fixed," or, "fused," image may be more resistant to alteration, for example, by deformation of the receiving member, such as, a film or a paper, or to abrasion or friction, or other mechanical force applied to the surface of the receiving member, such as, pressure or weight applied to a printed image, by, for example, another receiving member placed thereon, manual or tactile exposure and so on.

The following Examples illustrate embodiments of the instant disclosure. The Examples are intended to be illustrative only and are not intended to limit the scope of the present disclosure. Parts and percentages are by weight unless otherwise indicated. As used herein, "room temperature," (RT) refers to a temperature of from about 20° C. to about 30° C.

EXAMPLES

A latex emulsion comprised of polymer particles generated from the emulsion polymerization of styrene, n-butyl acrylate and β-CEA was prepared as follows. A surfactant solution consisting of 0.6 grams Dowfax 2A1 (anionic emulsifier) and 687 grams deionized water was prepared by mixing for 10 minutes in a stainless steel holding tank. The holding tank then was purged with nitrogen for 5 minutes before transferring the contents into a reactor. The reactor was continuously purged with nitrogen while being stirred at 100 rpm. The reactor was heated to 80° C. at a controlled rate and held at that temperature. Separately, 6.1 grams of ammonium persulfate initiator were dissolved in 30.2 grams of deionized water. Separately, a monomer emulsion was prepared by mixing 311.4 g of styrene, 95.6 g of butyl acrylate and 12.21 g of β-CEA, 2.88 g of 1-dodecanethiol, 1.42 g of 1,10-decanediol diacrylate (ADOD), 8.04 g of Dowfax 2A1 (anionic surfactant) and 193 g of deionized water to form an emulsion. One % of the above emulsion was fed slowly into the reactor containing the aqueous surfactant phase to form, "seeds," while being purged with nitrogen. The initiator solution was charged slowly into the reactor and after 10 minutes the rest of the emulsion is fed continuously into the reactor using a metering pump at a rate of about 0.5%/min. Once all the monomer emulsion was charged into the main reactor, the temperature was held at 80° C. for an additional 2 hours to complete the reaction. Full cooling then was applied and the reactor temperature was reduced to 35° C. The product was collected into a holding tank.

The pigment dispersion used was an aqueous dispersion of Blue 15:3 pigment from Sun Chemicals. The pigment dispersion contained an anionic surfactant. The pigment content of the dispersion was 17%, 2% surfactant and 81% water.

Then, 156 grams of the styrene latex from the holding tank having a solids loading of 40 wt % and 45.3 g of wax emulsion (the control contained a polyethylene wax with a melting point of 98° C. and the experimental contained a lower melting paraffin wax with a melting point of 82° C.) having a solids loading of 30.50 wt % were added to 500 grams of deionized water in a vessel and stirred using an IKA Ultra Turrax® T50 homogenizer operating at 4,000 rpm. Thereafter, 36.2 g of the pigment dispersion having a solids loading of 17 wt % was added to the reactor, followed by drop-wise addition of 23 g of a flocculent solution containing 2.3 g polyaluminum chloride mixture and 20.7 g 0.02 M nitric acid solution. As the flocculent mixture was added drop-wise, the homogenizer speed was increased to 5,200 rpm and the total mixture was homogenized for an additional 5 minutes. Thereafter, the mixture was heated at 1° C. per minute to a temperature of 45° C. and held at that temperature for a period of about 3 hours resulting in a volume average particle diameter of 6.1 μm as measured with a Coulter Counter. Additional 74 g of the styrene latex were added to the reactor mixture and allowed to aggregate overnight at 45° C. resulting in a volume average particle diameter of 6.3 μm. Eight grams EDTA (Versene 100) having a solids loading of 39 wt % were added to the aggregates followed by 4.0% sodium hydroxide solution to raise the pH of the reactor contents to 6.5. Thereafter, the reactor mixture was heated at 1° C. per minute to a temperature of 93° C. After about 15 minutes, the pH of the reactor was reduced to 4.8 with 4% nitric acid solution. The reactor mixture was stirred at 93° C. for 4 hours to enable the particles to coalesce and to spheroidize. The reactor heater then was turned off, the reactor content was quenched with deionized water and the reactor mixture was allowed to cool to room temperature.

The low melt paraffin wax toner had similar particle size and GSD as that of the polyethylene wax toner control, however the shape of the paraffin wax-containing toner was more spherical than the control particles. The MFI of the paraffin wax toner was higher, lending improved flow and release of the image. The rheology studies showed the G', G" and viscosity were lower for the particles with the paraffin wax than for the particles composed of the higher melting wax, lending improvement of the experimental toner of interest to paper adhesion during transfer and fusing.

TABLE 1

Property Comparisons between Control and Experimental Toners.

| Batch ID | Wax % | Wax Type | $VD_{50}$ | $ND_{50/16}$ | $VD_{84/50}$ | Circularity | % Moisture | MFI | Rheology @ 10 Radians/sec G' | G" | tan (d) | viscosity |
|---|---|---|---|---|---|---|---|---|---|---|---|---|
| control | 13% | Polyethylene | 6.62 | 1.243 | 1.211 | 0.958 | 0.22 | 16.9 | 12668 | 16179 | 0.78 | 1658 |
| Experimental Toner | 6% | Paraffin | 6.49 | 1.23 | 1.19 | 0.966 | 0.21 | 19.9 | 8528 | 11785 | 0.72 | 1237 |

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art, are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising a core and a shell, wherein the core comprises a core resin and a low melt wax selected from the group consisting of paraffin wax, microcrystalline wax, montan wax, ozokerite wax, Japan wax, Jojoba wax, beeswax, carnauba wax and combinations thereof, wherein the low melt wax has a melting point of less than about 95° C., and the shell comprises a shell resin, wherein the $T_g$ of the core resin is the same as the $T_g$ of the shell resin but the Tg of the core is less than the Tg of the shell.

2. The toner of claim 1, wherein the toner has a melt flow index (MFI) of at least about 18 gm/10 min at a temperature of about 125° C. and a 5 kg load.

3. The toner of claim 1, wherein the $T_g$ of the core is less than about 60° C.

4. The toner of claim 1, wherein the $T_g$ of the core is less than about 50° C.

5. The toner of claim 1, wherein the shell resin is selected from the group consisting of styrene acrylates, styrene butadienes, styrene methacrylates and combinations thereof.

6. The toner of claim 1, wherein the toner further comprises a colorant.

7. The toner of claim 1, wherein the toner is an emulsion aggregation toner.

8. The toner of claim 1, wherein the toner comprises a viscosity of less than about 1400 P.

9. A developer comprising the toner of claim 1, wherein said developer comprises improved fusing as compared to a developer comprising toner comprising: (1) a high melt wax, (2) a core resin $T_g$ lower than or higher than that of the shell resin, or both (1) and (2).

10. The developer of claim 9, wherein said low melt wax has a melting point of about 85° C. or less.

11. A toner comprising a core and a shell, wherein the core comprises a core resin and a low melt wax, wherein the low melt wax is selected from the group consisting of paraffin wax, microcrystalline wax, montan wax, ozokerite wax, ceresin wax, petrolatum wax, petroleum wax and combinations thereof, and the shell comprises shell resin wherein the $T_g$ of the core resin is the same as the $T_g$ of the shell resin but the Tg of the core is less than the Tg of the shell, wherein the onset Tg of the toner is from about 48° C. to about 54° C.

12. The toner of claim 11, wherein the low melt wax comprises a paraffin wax.

13. The toner of claim 11, wherein said wax is present in an amount of from about 1 to about 6%.

14. The toner of claim 11, wherein the toner has a melt flow index (MFI) of at least about 18 gm/10 min at a temperature of about 125° C. and a 5 kg load.

15. The toner of claim 11, wherein the core $T_g$ is less than about 50° C.

16. The toner of claim 11, wherein the low melt wax has a melting point of less than about 90° C.

17. A developer comprising the toner of claim 11, wherein said developer comprises improved fusing as compared to a developer comprising toner comprising: (1) a high melt wax, (2) a core resin $T_g$, lower than or higher than that of the shell resin, or both (1) and (2).

18. The developer of claim 17, wherein said low melt wax has a melting point of about 85° C. or less.

* * * * *